US011156443B2

(12) United States Patent
Pedicini et al.

(10) Patent No.: US 11,156,443 B2
(45) **Date of Patent: *Oct. 26, 2021**

(54) NON-LETHAL PROJECTILE CONSTRUCTION AND LAUNCHER

(71) Applicant: NL Enterprises, LLC, Cheyenne, WY (US)

(72) Inventors: Christopher Pedicini, Franklin, TN (US); Joshua Pedicini, Franklin, TN (US)

(73) Assignee: NL Enterprises, LLC, Cheyenne, WY (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/026,249

(22) Filed: Sep. 20, 2020

(65) Prior Publication Data

US 2021/0095941 A1 Apr. 1, 2021

Related U.S. Application Data

(63) Continuation-in-part of application No. 16/586,422, filed on Sep. 27, 2019, now Pat. No. 10,782,109.

(60) Provisional application No. 62/943,865, filed on Dec. 5, 2019.

(51) Int. Cl.

| | |
|---|---|
| ***F42B 12/40*** | (2006.01) |
| ***F42B 12/46*** | (2006.01) |
| ***F42C 11/00*** | (2006.01) |
| ***F42C 11/06*** | (2006.01) |
| ***F42B 12/76*** | (2006.01) |
| *F42C 13/04* | (2006.01) |

(52) U.S. Cl.
CPC ..... *F42B 12/40* (2013.01); *F42B 12/46* (2013.01); *F42B 12/76* (2013.01); *F42C 11/001* (2013.01); *F42C 11/06* (2013.01); *F42C 13/042* (2013.01)

(58) Field of Classification Search
CPC ..... F42C 11/02; F42C 11/04; F42C 11/008; F42B 12/40
See application file for complete search history.

(56) References Cited

U.S. PATENT DOCUMENTS 5,192,827 A * 3/1993 Jasper, Jr. ..... F41H 13/0068 102/501
5,698,815 A * 12/1997 Ragner ..... F41H 13/0006 102/293
6,679,180 B2 * 1/2004 Warnagiris ..... F41H 13/0031 102/293

(Continued)

*Primary Examiner* — Joshua T Semick
(74) *Attorney, Agent, or Firm* — Jay Schloff; Aidenbaum Schloff and Bloom PLLC

(57) ABSTRACT

A nonlethal projectile includes a payload for immobilizing and/or identifying a target. The projectile is capable of separating or otherwise opening after launch by a launcher to release the payload prior to impact with a target. The launcher is capable of initiating separation of the projectile. Opening may also be accomplished by a control circuit with a radio-frequency identification (RFID), where an RFID tag in the projectile causes the projectile to open at a specified distance from the launcher. The launcher may include a trigger and/or a safety switch to prevent the projectile from becoming armed until a certain parameter is met. A magazine or breech assembly of the launcher may energize the projectile prior to launch of the projectile.

16 Claims, 16 Drawing Sheets

(56) References Cited

U.S. PATENT DOCUMENTS

| | | | | |
|---|---|---|---|---|
| 7,065,915 | B2 * | 6/2006 | Chang | F41C 9/00 102/502 |
| 7,526,998 | B2 | 5/2009 | Vasel et al. | |
| 8,256,351 | B1 * | 9/2012 | Kramer | F42C 11/065 102/502 |
| 9,921,041 | B1 * | 3/2018 | Hoang | F42C 11/06 |
| 10,288,398 | B1 * | 5/2019 | Verini | F42B 30/006 |
| 2005/0188886 | A1 | 9/2005 | Vasel et al. | |

* cited by examiner

NON-LETHAL PROJECTILE CONSTRUCTION AND LAUNCHER

CROSS-REFERENCE TO RELATED APPLICATIONS

The present disclosure is a continuation-in-part of and claims priority under 35 U.S.C. § 120 on pending U.S. Non-provisional application Ser. No. 16/586,422, filed on Sep. 27, 2019, the disclosure of which is incorporated by reference. The present disclosure also claims priority under 35 U.S.C. § 119 on U.S. Provisional Application Ser. No. 62/943,865, filed on Dec. 5, 2019, the disclosure of which is incorporated by reference.

FIELD OF THE DISCLOSURE

The present disclosure relates to projectiles for use in non-lethal weapons or other launching mechanisms and more specifically, to those projectiles and launchers which use compressed gas or batteries for operation, for example.

BACKGROUND OF THE DISCLOSURE

Non-lethal projectiles and non-lethal launching systems are commonly used by law enforcement for purposes of crowd control, such as quelling a riot or angry mob or to individually subdue a suspect. Increasingly, they may find usage as another means to augment self-defense in situations such as a home invasion, for example. The projectiles and systems (such as weapons that are capable of delivering such non-lethal projectiles) are designed to subdue a target subject or subjects for a time without causing permanent harm. Typically, such weapons systems require a projectile to burst on impact with the suspect and thus require accurate targeting and, in some cases, cause severe injury to a suspect. The most common means for such a device is a projectile that bursts on impact or a targeting device tethered by wires which delivers a high voltage shock thus immobilizing the suspect. All of these existing means suffer from a number of disadvantages outlined in more detail below.

The use of high voltage electric shock has been around for a number of years. While it is fairly effective at immobilizing a suspect, it suffers from the drawbacks that cardiac arrest in the target/suspect may result due to the voltage imparted into the suspect's body. Additionally, in the case of a suspect who is not in an open or unconstrained environment, such means requires accurate targeting to ensure that the electrodes contact the individual in order to deliver the electric shock. Furthermore, the longest effective range for such a device is less than 30 feet and more typically 10 or 15 feet. Additionally, the effectiveness of such weapons can be inhibited by clothing, coats or wet environments.

A second technique involves the use of a paintball that is filled with a *capsicum* or PAVA powder. While this eliminates or improves on the range issues of the electric shock techniques, it requires accurate targeting of the suspect. This is extremely difficult to do in short range as the ricochet of the powder off of a suspect can cause it to come back to the user. Furthermore, upon impact, the control of the powder release is not necessarily effective and can be one dimensional, meaning that it has difficulty stopping a suspect who is running away—as the cloud is left behind. Additionally, if the impact does not burst the projectile, the intended effect is not achieved.

Another approach is to provide for a projectile, the rupture or separation of which is caused by components that are powered by a battery or batteries that is/are internal to the projectile. However, batteries are inherently respectively large and heavy when compared to a projectile, and therefore limit the potential configurations of the projectile (due at least to the fact that the batteries occupy a substantial amount of space within the projectile). Batteries being inherently heavy increase the weight of the projectile which can result in unintended injury to the target upon impact. Furthermore, batteries are relatively expensive, thereby driving up the cost of manufacture of such a projectile. Furthermore, and quite concerningly, batteries drain and lose charge over time, which means that a projectile so configured may not be in a usable state for firing if it has been on the shelf for a length of time. This drawback is not acceptable, as the conditions under which such projectiles are to be used requires that they be ready to fire at all times.

All of the currently available methods suffer from one or more of the following disadvantages: difficult to target, not suitable for close range, not suitable for long range, inaccurate, sometimes lethal and often otherwise not effective, costly to manufacture, complex in configuration, and not reliably powered.

SUMMARY OF THE DISCLOSURE

In view of the foregoing disadvantages inherent in the prior art, the general purpose of the present disclosure is to provide a projectile construction (also referred to herein as "projectile" in context) and projectile launcher that include all the advantages of the prior art, and overcomes the drawbacks inherent therein. As used herein, it is understood that a payload of the projectile material can be in powder, liquid or aerosol, or foam form (or a combination thereof) without departing from the spirit of the disclosure. The payload may comprise a debilitating material, a visible substance (such as a dye or a powder, for example) or an invisible marking substance (such as a UV-reactive material, for example) or a combination thereof. The projectile also preferably comprises an energy storage means. As used herein, "energy storage means" is a storage means that lacks sufficient energy (such as a charge, for example) to activate or arm the projectile or another component of the projectile until the energy storage means has been energized or re-energized by an outside source (such as a launcher or an accessory thereof). The minimum energy to activate or arm the projectile (or to imitate a reaction as described elsewhere herein) is referred to as the "threshold energy", meaning that at energy levels below the threshold energy, the projectile will not be armed or activated and/or cannot initiate a mechanical or chemical reaction. In an embodiment, the energy storage means comprises a capacitor, which capacitor may be charged or energized by the launcher or launcher accessory prior to launching of the projectile.

In a non-limiting embodiment the projectile comprises one of PAVA, Capsaicin, Dihydrocapsaicin (DHC), Nordihydrocapsaicin (NDHC), or other capsaicinoid derived debilitating powder that may be released in proximity of a target.

In an embodiment, the projectile separates into two or more components after it leaves the barrel of a launcher or has an opening created therein to distribute a payload. In an embodiment, the separation can be initiated by electrical, mechanical or chemical means or by a combination thereof. In a still further embodiment, the initiation can be varied depending on the distance to the suspect or target.

In another embodiment the projectiles include various means of adjustment of the aforementioned embodiments in which the release or dispersion of the payload occurs at fixed or predetermined distances from the barrel of the launcher.

In a still further embodiment, the debilitating material of a payload is configured to deliver an effective debilitating dose. For example, with a projectile having a 10% concentration of powder at 1 g/cc and 3 cc total volume, the amount of active agent is 0.3 g, which may generate a 0.06 $m^3$ envelope at 5 ppm concentration. This is roughly equivalent to a 0.5 meter diameter sphere.

In another embodiment, an electrical circuit may be contained within the projectile. The electrical circuit may either initiate a chemical reaction or otherwise cause a separation of the projectile through an electromechanical method. Such methods can include an electromagnet, shape memory alloy or the like. The release may be controlled such that the separation is in proximity of the target. The control may include calculations based on the projectile velocity as well as the distance to the target. The electrical circuit and reaction can be initiated when the energy storage means has been sufficiently energized, i.e., beyond the threshold energy—such energizing being done by the launcher or other outside source, for example.

In a still further embodiment to a projectile containing an electrical component, the electrical circuit may be activated by the launcher and/or an accessory of a launcher (such as a magazine, for example). Such means of activating can include direct electrical connection, inductive charging or the like. By limiting activation to the launcher and or accessories of the launcher, it is possible to encode the projectile and improve the safety characteristics by reducing the likelihood of an accidental release of the projectile payload.

In a further embodiment the housing of the projectile can include identification means which designate directly or indirectly the payload composition. For example, a red line around the housing could indicate that the projectile payload is of a debilitating material.

In a still further embodiment, the electrical circuit can be activated by a motion sensing switch such as an accelerometer, vibration sensor, or the like, at launch of the projectile.

In a still further embodiment in which the separation is a result of a chemical reaction, a reactive compound (such as nitrocellulose for example) may be initiated with an "electric match" or other such initiator. The electric match may consist of a nichrome or similar high resistance wire that is coated with a pyrogen and is initiated with electrical energy such as from a battery, capacitor, or the like. In an embodiment, the pyrogen or initiator may be incorporated in a printed circuit board or an integrated circuit such as by way of a thin trace, for example. In a still further embodiment this may all be accomplished on a single chip such as an ASIC for example.

In another embodiment the separation or opening of the projectile is initiated by the force of the launch upon the projectile.

In a still further embodiment, the projectile launcher and the projectile are part of a system in which the projectile is encoded with timing and or distance information as a result of range to target. The projectile launcher may further include a range finder or other means for measuring distance to a target. The launcher and projectile can be configured to be in wired or wireless communication with each other. In a still further embodiment, a GPS means may be used to control the projectile payload activation and/or release.

DESCRIPTION OF THE DRAWINGS

The advantages and features of the present disclosure will become better understood with reference to the following detailed description and claims taken in conjunction with the accompanying drawings, wherein like elements are identified with like symbols, and in which:

DETAILED DESCRIPTION OF THE DISCLOSURE

The exemplary embodiments described herein detail for illustrative purposes are subject to many variations in structure and design. It should be emphasized, however, that the present disclosure is not limited to a particular projectile or projectile launcher as shown and described. That is, it is understood that various omissions and substitutions of equivalents are contemplated as circumstances may suggest or render expedient, but these are intended to cover the application or implementation without departing from the spirit or scope of the claims of the present disclosure. The terms "first," "second," and the like, herein do not denote any order, quantity, or importance, but rather are used to distinguish one element from another, and the terms "a" and "an" herein do not denote a limitation of quantity, but rather denote the presence of at least one of the referenced item. It is further understood that although the term PCB is used, this may also refer to discrete or single components without departing from the spirit of the disclosure.

Figure 10:
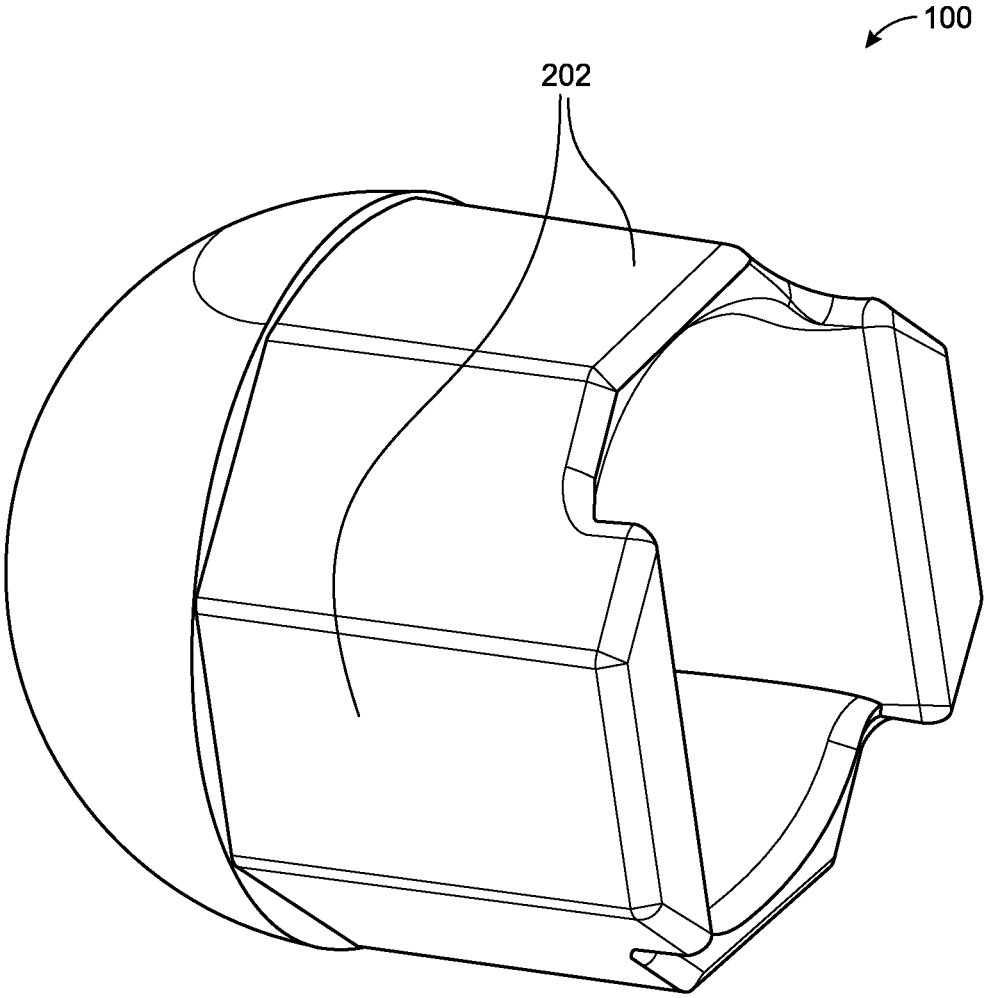
FIG. 10 shows a projectile having a housing that comprises at least two parallel sides, in accordance with an exemplary embodiment of the present disclosure.

The present disclosure provides for a nonlethal projectile 100 and a launcher 1000 for such a projectile 100, the launcher 1000 and projectile 100 comprising a system. It will be understood that the launcher 1000 may comprise a launcher as well as accessories therefor such as a magazine or energy source or other components. The projectile 100 preferably comprises a payload 200. In an embodiment, the payload 200 may comprise a debilitating material (such as capsaicin, PAVA, tear gas, etc.), a visible substance and/or a invisible marking substance for immobilizing and/or marking a target, suspect or boundary. The projectile 100 preferably comprises an enclosure, which enclosure may be formed by an at least partially annular-shaped shell 102. The shell may include a closed, substantially planar end portion 104 (also referred to herein as "end cap") that corresponds to a radius of the annular portion of the shell to form the enclosure. The shell and end portion may individually and collectively be referred to herein as a housing of projectile 100. In another embodiment, the housing of the projectile comprises at least two parallel sides (sides 202 as shown in FIG. 10). The payload 200 is contained in the enclosure prior to launch of the projectile 100. In an embodiment, the projectile 100 is capable of self-separating, disintegrating or otherwise opening prior to impact with a target. In an embodiment, the launcher 1000 is capable of initiating a separation or disintegration or rupturing or opening, etc. of the projectile 100 and/or an event that leads to separation or disintegration or rupturing or opening, etc. of the projectile 100. In an embodiment, the launcher 1000 is capable of communicating to the projectile 100 and or arming a projectile 100 prior to or coincident with projectile launch. In another embodiment, the launcher comprises a safety and/or trigger, which safety and/or trigger, until activated, prevent the projectile from becoming armed. The arming can be, for example, the charging of an energy storage element or means contained within the projectile. In an embodiment, the launcher comprises a breech and/or a breech assembly in which a projectile or projectiles may be loaded prior to launch.

Figure 9:
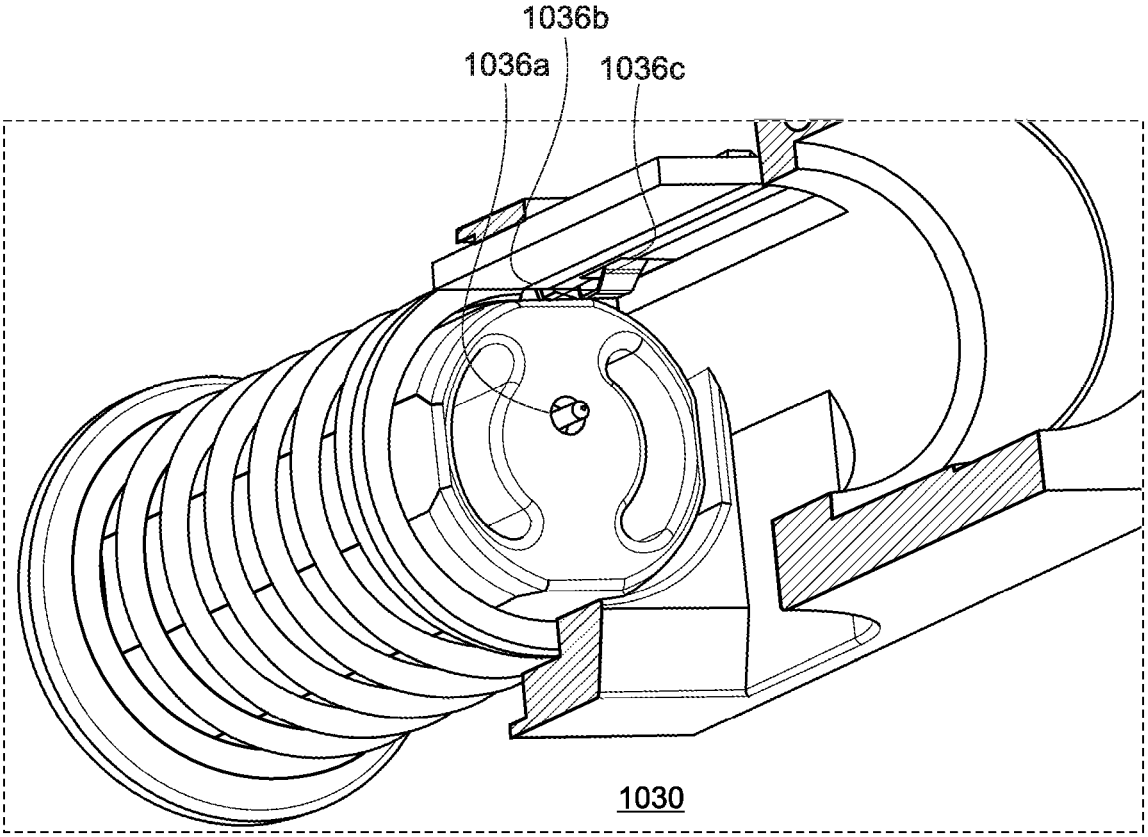
FIG. 9 shows a breech assembly in which the energy storage means of a projectile may be charged or energized past a threshold energy by contact with an element of the launcher such as a bolt, in accordance with an exemplary embodiment of the present disclosure.
Figure 12:
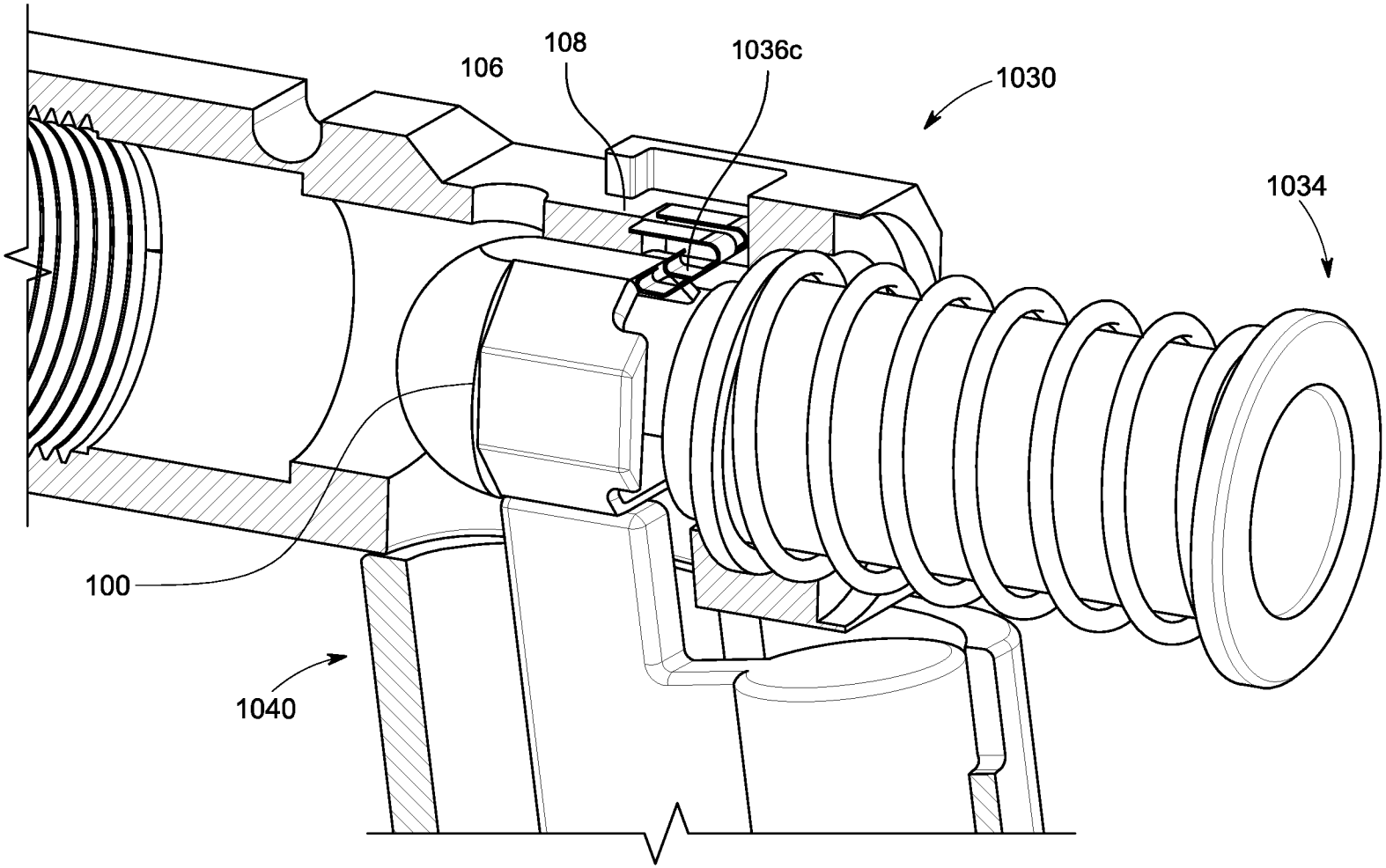
FIG. 12 shows charging elements of a bolt and breech assembly for charging a projectile after a projectile is positioned in the breech of a launcher, in accordance with an exemplary embodiment of the present disclosure.

The breech assembly 1030 includes a barrel 1010, a breech (which breech is, in an embodiment, an opening or space in the breech assembly 1030 that may arise from a positioning of the bolt 1034) at least one projectile inlet 1032 and a bolt 1034. The projectile inlet 1032 is adapted to receive a projectile into the breech. The bolt 1034 includes a front portion and a rear portion and may be configured to be partially received within the barrel 1010 such that the front portion of the bolt 1304 shuts off the projectile inlet 1032 and in the second position the bolt 1034 is configured to enable the projectile 100 to enter the barrel 1010 from the projectile inlet 1032. The breech assembly may also comprise charging elements 1036, for charging the projectile as described below and as shown in FIGS. 9 and 12. In an embodiment, and as shown in FIG. 9, the breech assembly comprises one or more conductive probes (shown in FIG. 9 as 1036*a* and 1036*b*) and a conductive finger 1036*c*. Such probes or fingers may further comprise a spring or other biasing element.

Figure 2:
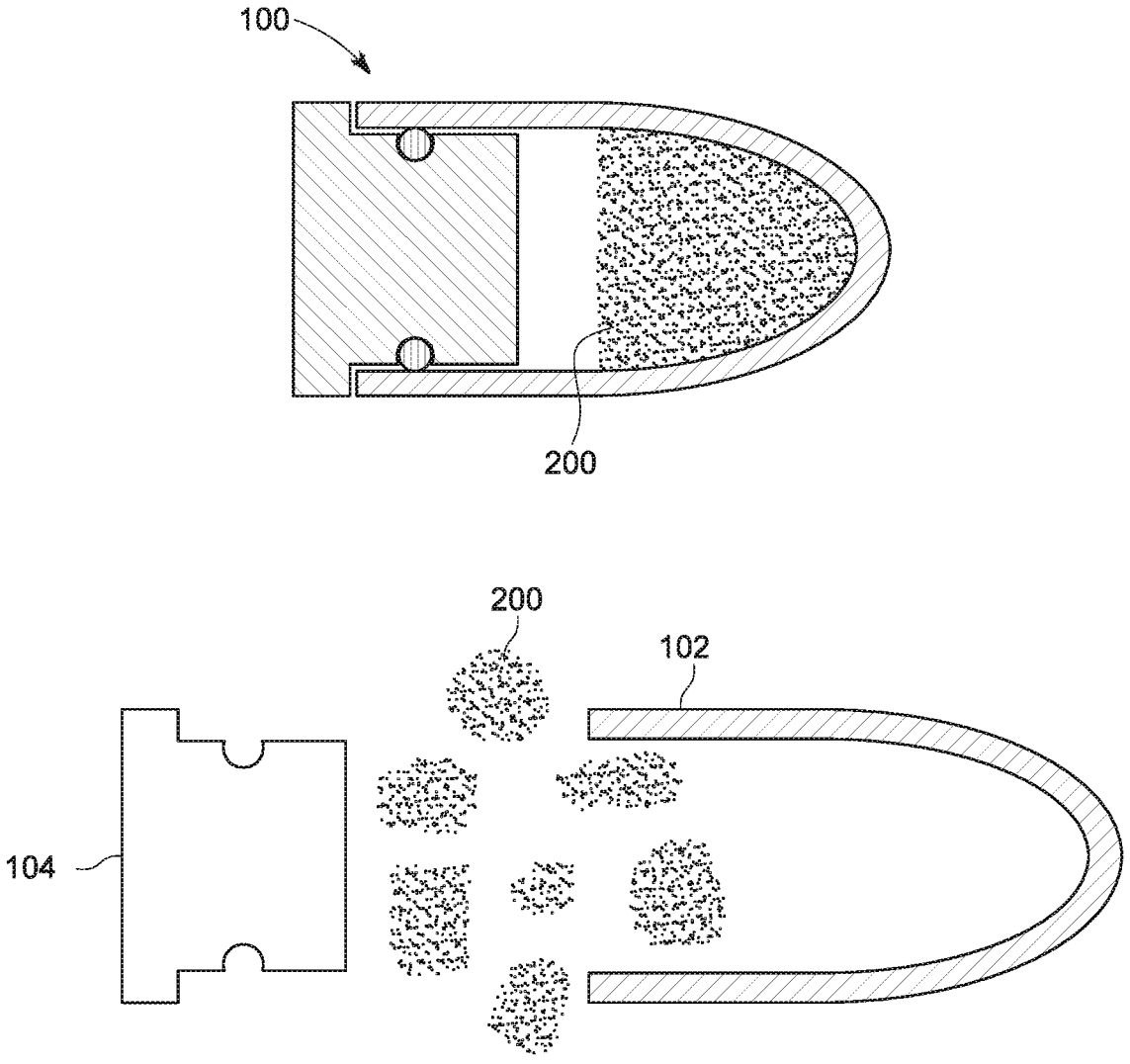
FIG. 2 is views of a projectile both before launch and then during flight in which the housing of the projectile has separated and released a debilitating material, in accordance with an exemplary embodiment of the present disclosure.
Figure 2C:
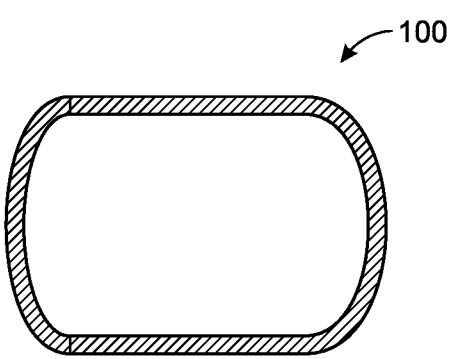
FIG. 2C shows a projectile having a single-piece housing construction, in accordance with an exemplary embodiment of the present disclosure.
Figure 2B:
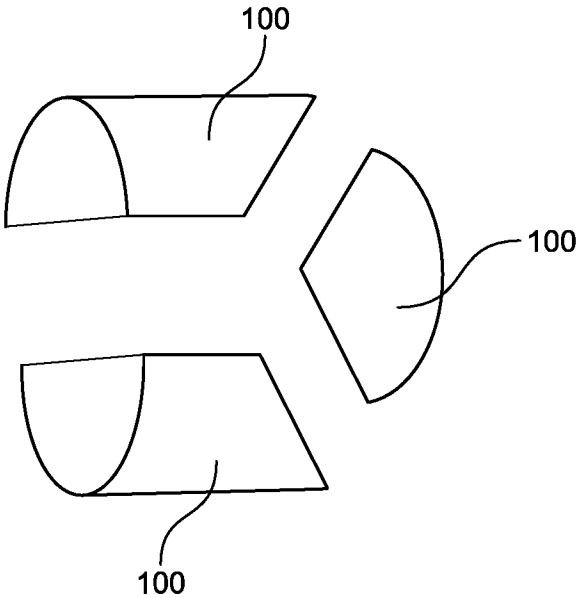
FIGS. 2A and 2B are views of a projectile that comprises fracture lines before (2A) and after (2B) the projectile has separated or fragmented along the fracture lines, in accordance with an exemplary embodiment of the present disclosure.
Figure 2A:
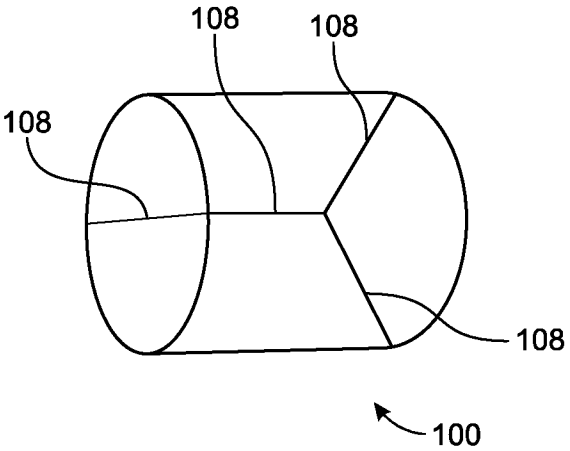

The planar end portion 104 of the projectile 100 is preferably removably attachable to the annular portion of the shell 102. The attachability of the planar end 104 to the annular portion may be a crimp, press fit, threaded connection, or via adhesive or other bond, for example. The attachability allows for ease of access to the enclosure formed by the planar end portion 104 and annular portion of the shell 102. The planar end portion 104 of the shell may have a greater dimension than the diameter of the annular portion of the shell 102 against which it attaches to create a flange. In another embodiment, the shell 102 comprises a first annular portion and a second annular portion in which the planar end portion 104 is fixedly attached to said first annular portion and in which the first annular portion and second annular portion are removably attached to one another such that the enclosure of the shell 102 may be opened elsewhere than the planar end portion 104 of the shell In an embodiment, and as shown in FIGS. 2A and 2B the projectile housing comprises fracture lines, which fracture lines may comprise comparatively weaker or thinner sections of the housing, along which fracture lines the projectile housing may rupture after launch. In another embodiment, at least a portion of the housing comprises a low-melting point polymer for facilitating melting and opening of the housing by an initiator described elsewhere herein. In yet another embodiment, the housing of the projectile is a single piece, as shown in FIG. 2C, for example. In a further embodiment, the housing is frangible. In still another embodiment, the projectile comprises an elastomeric material or combustible housing.

Figure 11:
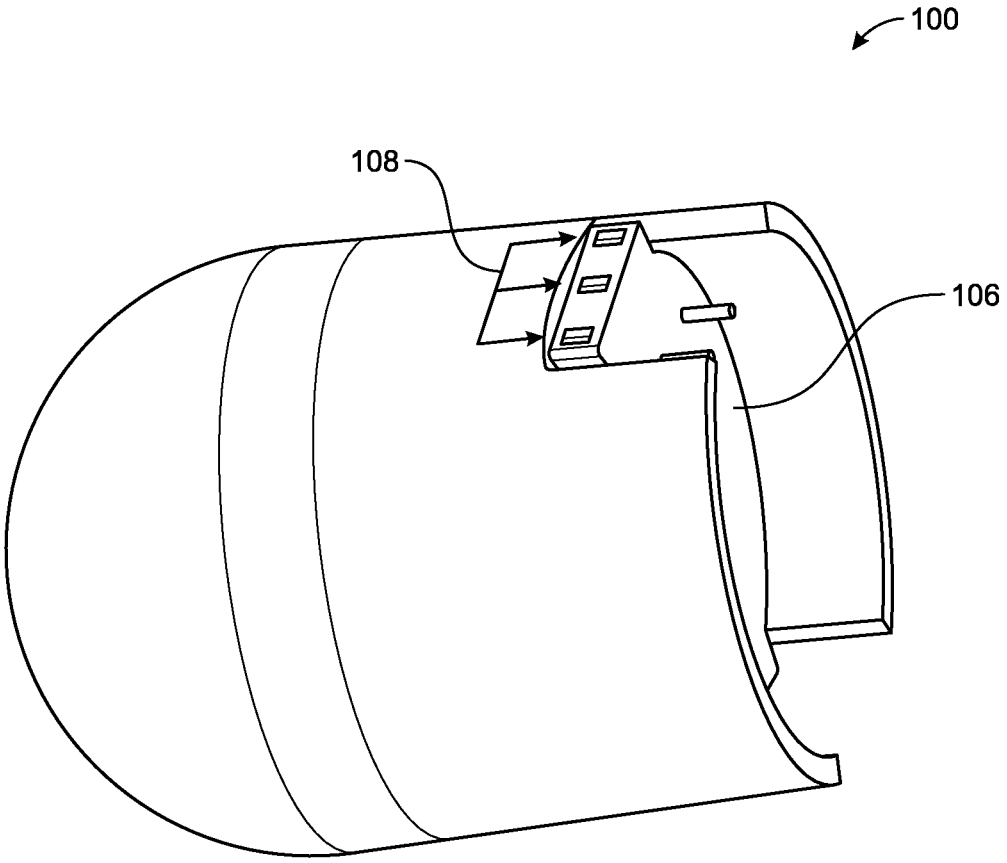
FIGS. 11 and 11A shows a projectile that comprises a printed circuit board, in accordance with an exemplary embodiment of the present disclosure.
Figure 11A:
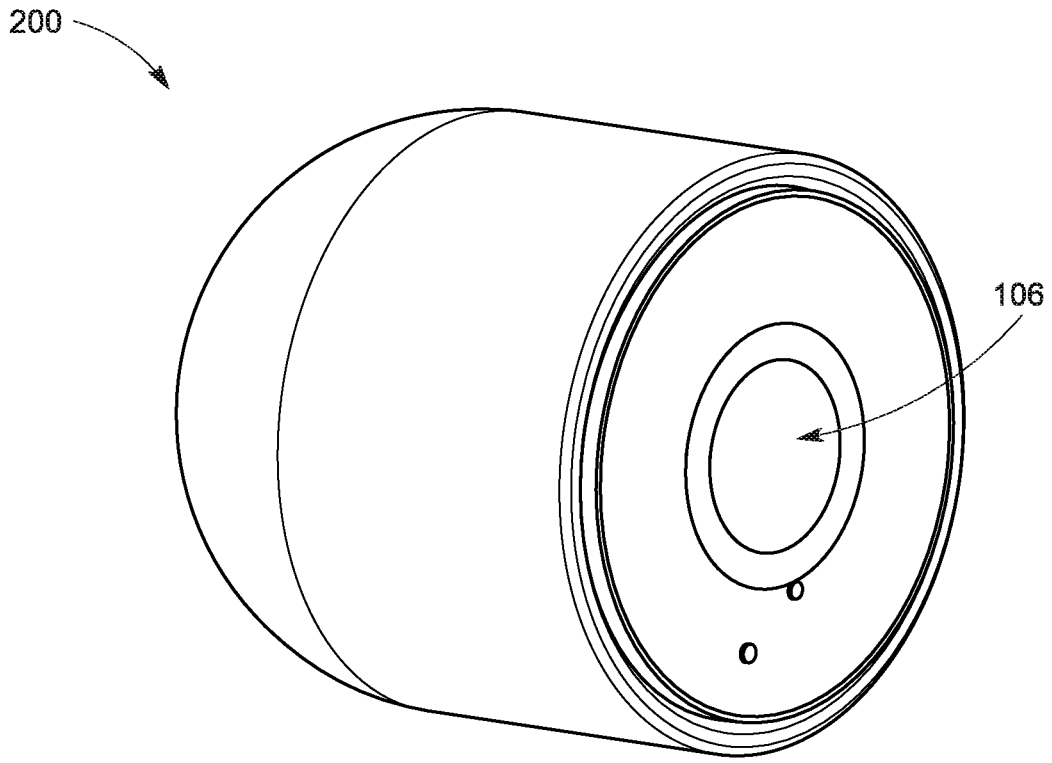

In another embodiment, and as shown in FIGS. 11 and 11A, the projectile comprises a printed circuit board ("PCB") 106. In an embodiment, the projectile PCB comprises one or more wired or wireless contacts (such as contacts 108), which contacts may receive a signal or other input from launcher, which input or signal may instruct the PCB to initiate a projectile separation timer or countdown. In another embodiment, bolt 1034 may contact the PCB 106 and transmit input or signal to the PCB 106, such as from the launcher control circuit 1040, such that when the projectile 100 is disposed in the breech 1030 and/or against the bolt 1034, a projectile separation timing or countdown may be initiated. In a still further embodiment, the bolt and/or breech assembly may comprise an energy source (such as a charger, for example) such that the energy storage means is energized past the threshold energy by contact with the bolt and/or charging elements 1036 of the breech assembly. In a further embodiment, the energization occurs in less than 100 milliseconds, and in yet a further embodiment, in less than 20 milliseconds. In a still further embodiment, a single chip such as an ASIC or discrete components may be utilized in place of or in addition to a PCB.

Figure 1:
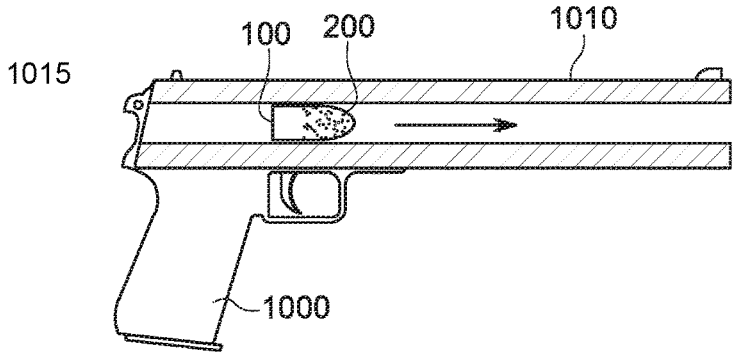
FIG. 1 is a longitudinal cross-sectional view of a projectile launcher with a projectile, according to an exemplary embodiment of the present disclosure.
Figure 1A:
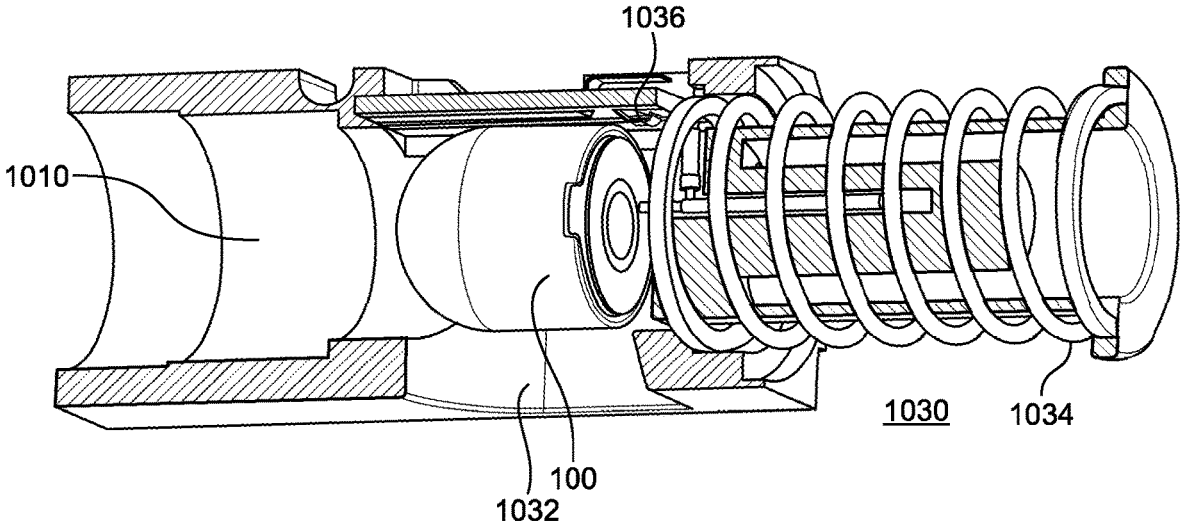
FIG. 1A is a view of a breech assembly of a projectile launcher, in accordance with an exemplary embodiment of the present disclosure.

An exemplary launcher 1000 is shown in FIG. 1. The launcher comprises a barrel 1010 for directing and launching a projectile 100. The launcher 1000 may also comprise a chamber 1015 for holding a projectile prior to firing thereof. In an embodiment, the chamber comprises the breech or breech assembly 1030 disclosed herein. It will be apparent that the launcher 1000 shown in FIG. 1 may be in other configurations so long as the launcher 1000 is capable of firing a projectile 100 of the projectiles disclosed herein.

The launcher 1000 may further comprise a control circuit 1040 (herein referred to launcher control circuit for clarity). The launcher control circuit 1040 may transmit inputs and/or signals to the projectile 100. The launcher control circuit 1040 may be activated when a projectile 100 is loaded into the breech 1040, for example. In an embodiment, the launcher control circuit 1040 is otherwise inactive until a projectile 100 is loaded into the breech. In a still further embodiment, the projectile remains inactive until the bolt contacts the projectile.

In an embodiment, the projectile 100 housing opens or otherwise separates after it leaves the barrel 1010 of a launcher 1000 to distribute a payload 200, in the form of a powder, aerosol, liquid, foam, or combination thereof. That is, the rupturing or breaching of the projectile housing or the separation of housing components creates an opening in the projectile 100 out of which the payload 200 may emanate or be released. In a further embodiment, the payload can be colored, marking, debilitating, or a combination thereof. For example, where the payload comprises a cloud of marking material or substance, marking material from the cloud can be used to identify individuals that were subjected to the effects of the projectile. The cloud may also be visible to form a deterrent, i.e., the cloud may comprise a visible barrier that discourages individuals from approaching the cloud or area of the cloud. In an embodiment, the constituent particles of the payload may be of a particle size, or may be attached to carrier particles, such that the payload cloud or other release is not affected by wind or other otherwise-motivating factors or environmental conditions. In an embodiment, the payload is aerosolized as a result of the rupture, separation or opening of the projectile.

In another embodiment the projectiles 100 disclosed herein include various means of adjustment of the aforementioned embodiments in which the release or dispersion of the payload 200 occurs at fixed or predetermined distances from the barrel 1010 of the launcher 1000. For example, selective release can be accomplished by a timed reaction.

Figure 4:
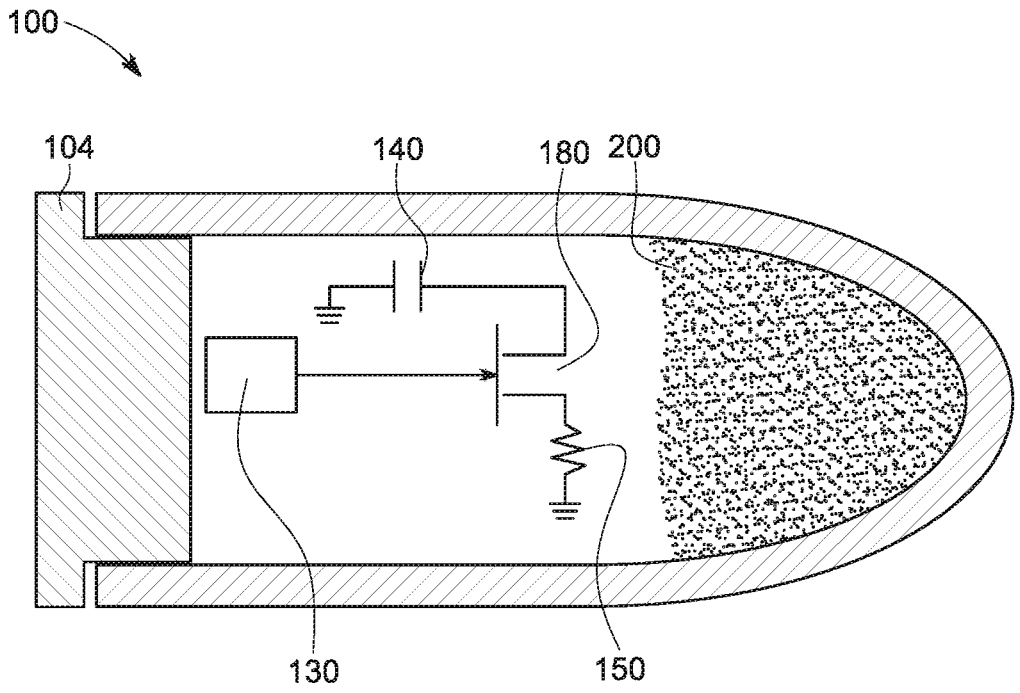
FIG. 4 is a view of a projectile comprising a payload, a control circuit, an initiator, and an energy storage means, in accordance with an exemplary embodiment of the present disclosure.

In another embodiment, the release may be accomplished by a control circuit 120. Such a control circuit 120 may include a radio-frequency identification (RFID), where an RFID tag in the projectile 100 may cause the projectile 100 to rupture at a user-specified distance from the launcher 1000. In a further embodiment, the control circuit comprises a timing circuit that may cause the projectile to rupture at a specified time after launch. In an embodiment, the control circuit 120 comprises an ASIC for incorporating all components on a single chip, which decreases the assembly and manufacturing time of the projectile and the footprint of the control circuit 120. In another embodiment as shown in FIG. 4, a reaction may be initiated in response to a timer 130. Furthermore such component may be initiated by a reaction and comprise materials such as nitrocellulose, $NaN_3$ or the like. In such an embodiment, it will be apparent that the launcher 1000 may comprise a transmitter or other means for communicating with the RFID tag or the reaction may be controlled by other means.

Figure 3:
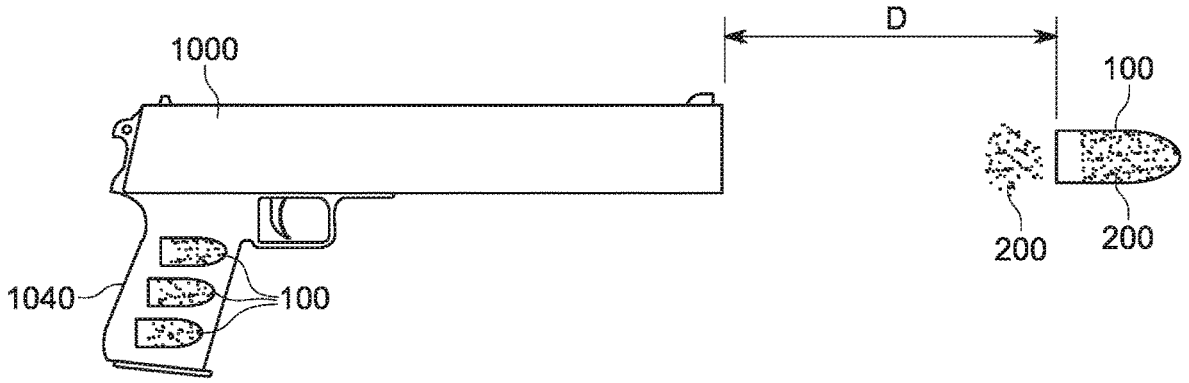
FIG. 3 is a view of a projectile launcher with a magazine in which the projectiles are set to rupture at various times/distances after launch, in accordance with an exemplary embodiment of the present disclosure.

As shown in FIG. 3, the launcher and projectile system may comprise a magazine 1040 that holds a plurality of projectiles 100 and that feeds said projectiles 100 to the launcher 1000 for firing/launching the projectiles 100. In an embodiment, the various projectiles 100 of the magazine 1040 may be configured to separate or rupture, etc. at the same distance "D" or time after launch, or they may be configured to separate or rupture, etc. at different distances and/or times after launch. In the embodiment where the various projectiles are configured to separate or rupture, etc. at the same distance "D" or time after launch, it will be apparent that a user may concentrate the effect of the debilitating material from the ruptured projectiles within a certain defined area. In an embodiment where the various projectiles are configured to separate or rupture, etc. at different distances and/or time after launch, it will be apparent that (1) the particular distance and/or time after launch at which the separation, etc. of each particular projectile of the various projectiles may be accomplished by selectively setting the separation, etc. of each projectile of the various projectiles as elsewhere set forth herein. Further, the separation, etc. of the various projectiles at different distances may provide for a more distributed dispersion of the payload in the event that dispersion of such material over a greater area is desired. In an embodiment mentioned elsewhere herein, wherein the housing of the projectile comprises at least two parallel sides, such sides of the projectile may be configured to facilitate a particular orientation of the projectile in the magazine of a launcher (or in the breech of a launcher). A cutaway view of an exemplary projectile of this embodiment is shown in FIG. 10. In a further embodiment, the magazine 1040 comprises an energy source 1042, which energy source may energize a projectile when the projectile is disposed in the magazine.

Referring again to FIG. 4, the projectile 100 may further comprise an energy storage means 140 (such as, but not limited to, a capacitor or a miniature Lithium ion rechargeable battery) and an initiator 150 (such as, but not limited to, a heating element). The energy storage means 140 and initiator 150 may be operatively coupled to a switch 180, and the timer 130 may cause the switch 180 to trip at a particular time after launch of the projectile 100, after which the energy storage means 140 may deliver stored energy to the initiator 150 to cause the initiator 150 to perform a reaction (such as heating) that results in the projectile 100 opening, separating or disintegrating to release the payload 200. As mentioned elsewhere herein, in an embodiment, the housing of the projectile 100 may comprise a low-melting point polymer to facilitate melting and opening of the housing by the initiator 150.

In an embodiment, the energy storage means is charged to a voltage that is related to the timing of the separation or opening of the projectile. For example, a voltage of 4 volts may correspond to a distance of 20 feet and a voltage of 5 volts may correspond to a distance of 100 feet. In preferred embodiment, the minimum threshold voltage to initiate a reaction in the projectile corresponds to the minimum charge of the energy storage means.

Figure 5:
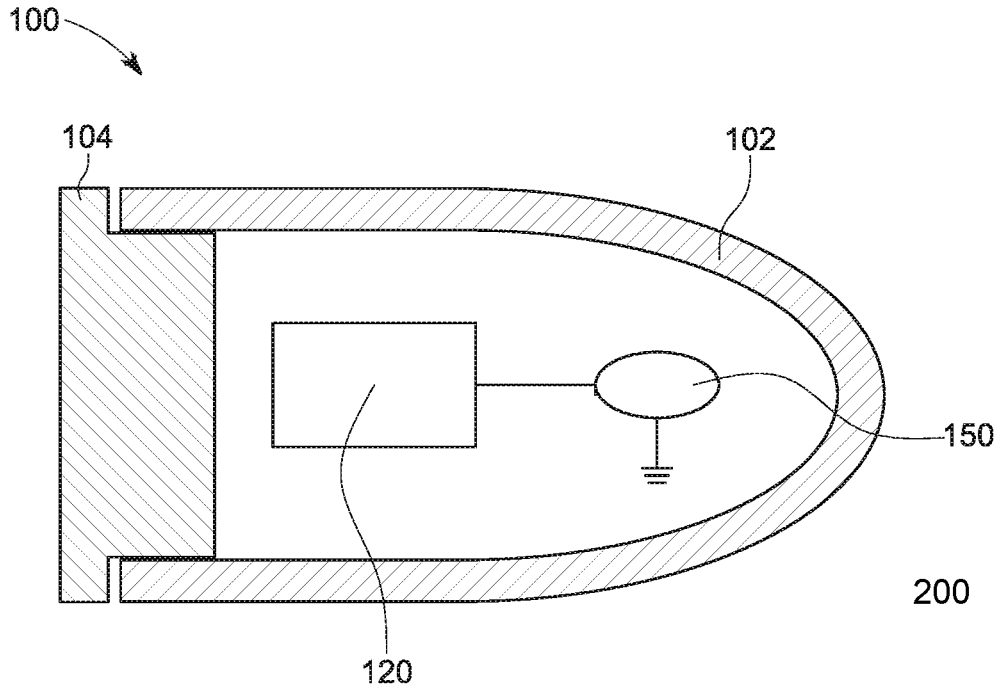
FIG. 5 is a view of a projectile comprising a payload, an initiator, and a control circuit, in accordance with another exemplary embodiment of the present disclosure.

In another embodiment, and referring to FIG. 5, the control circuit 120 is directly coupled to the initiator 150 such that the control circuit 120 activates the initiator 150. As shown in FIG. 5, the initiator 150 may be an electric match, which electric match may heat upon activation to create an opening in the shell of the projectile 100 to release the payload 200.

In another embodiment, the projectile launcher 1000 comprises a trigger and/or a safety switch, which trigger and/or switch prevent the projectile 100 from becoming armed until a certain parameter is met. For instance, the safety may be configured to prevent the projectile 100 from becoming armed unless it is turned to fire mode in the launcher 1000. In another embodiment, the energy storage means is in communication with trigger or safety switch and is not energized until after the trigger or safety switch is actuated. In yet another embodiment, the energy storage means is not fully energized until the trigger of the launcher is actuated and/or if enough force is detected to launch the projectile. With regard to force, in the exemplary case of a compressed-gas driven launcher, a pressure switch may be implemented to detect if a current gas pressure available exceeds the gas pressure needed to launch the projectile. Such trigger and safety switch can thereby prevent accidental firing or rupturing of a projectile in the event that the launcher is forcibly but unexpectedly moved, or if the user accidentally drops the launcher, for example.

Figure 6:
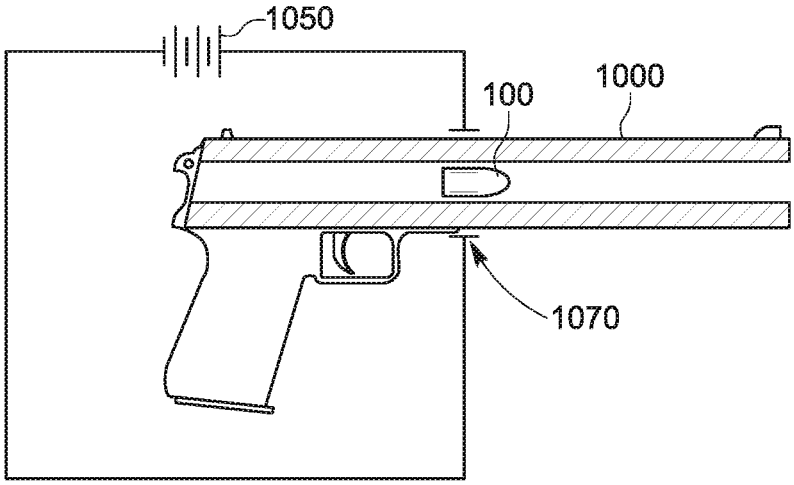
FIG. 6 shows a projectile and launcher in which the launcher may communicate to the projectile through at least one connection, in accordance with an exemplary embodiment of the present disclosure.
Figure 7:
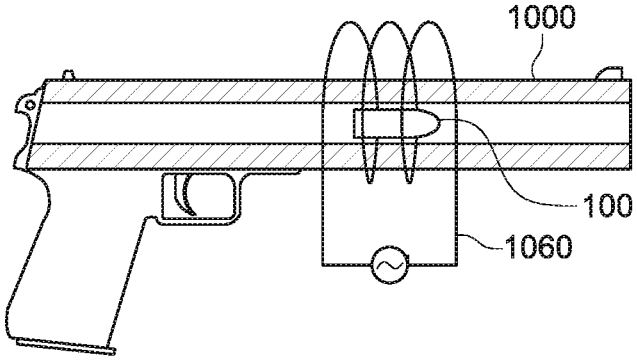
FIG. 7 shows a projectile and a launcher in which the projectile may communicate wirelessly with the launcher, in accordance with an exemplary embodiment of the present disclosure.
Figure 8:
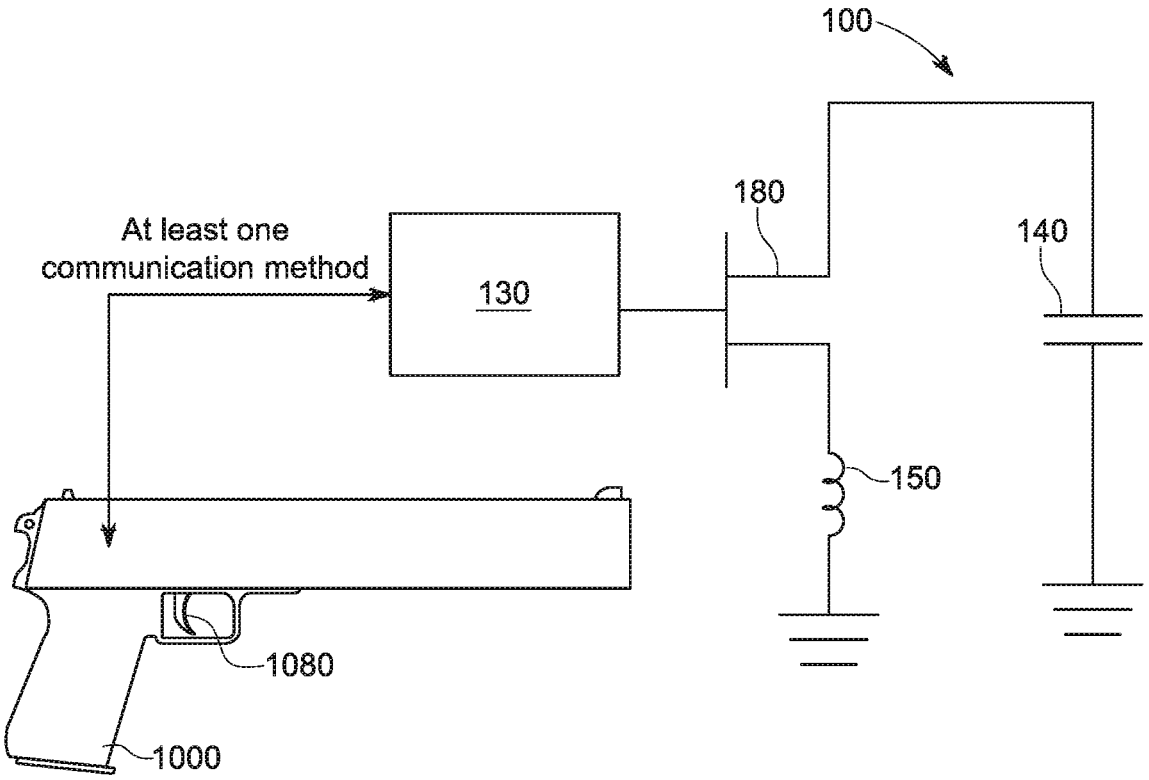
FIG. 8 shows a launcher, components of a projectile and at least one means of communicating information to the projectile, in accordance with an exemplary embodiment of the present disclosure.

In still another embodiment as shown in FIGS. 6, 7 and 8 the projectile 100 and the launcher 1000 communicate through at least one of a wireless or wired means. This allows the launcher to set parameters within the projectile allowing for more precise control of the point at which the housing is breached or ruptured or opened, i.e. to set a particular distance or time at which the projectile may rupture or open. In a still further embodiment, the projectile has an energy source (such as an energy storage means 140) which is activated or powered or energized by the launcher 1000 (for example, by means of a battery 1050 in the launcher that the projectile 100 may come into contact with when loaded in the launcher 1000, at a contact point 1070 as shown in FIG. 6) and thus enhances the safety profile of the projectile 100, e.g., by keeping the projectile 100 and dispersal means inactive until it is chambered in the launcher. In an embodiment, the energized energy storage means thereafter may power the control circuit. In another embodiment, as shown in FIG. 7, the projectile (and, in an embodiment, the energy storage means 140 thereof) can be charged or energized via induction, such as via an inductive charger 1060. In a still further embodiment, the launcher 1000 includes a means for measuring distance, such as a range-finder, which means may communicate with the control circuit 120 and which means may permit in-situ customization of at least one parameter related to the burst or breach of the projectile 100, thus further increasing its ability to disperse the debilitating material 200 at a more preferred or precise location. As shown in FIG. 8, the launcher 1000 may comprise a trigger 1080 to initiate the launch process. It will be apparent that the charging of the energy storage means by the launcher eliminates the requirement that the energy storage means comprise a self-contained power source (i.e., a battery for the energy storage means is not required), thereby eliminating the possibility that the energy storage means will suffer a power drain prior to launch. It will be apparent that the energy storage means can also be energized by an outside source other than the launcher prior to loading in the launcher. Further, a capacitor as an exemplary storage means is significantly lighter and cheaper than a battery, thereby improving performance and reducing the cost of manufacture of the present projectile. Although a capacitor is referenced presently, it will be apparent that this reference is not meant to be limiting and that other energizable solutions such as small rechargeable batteries may be used.

In another embodiment, the breech assembly further comprises a charger that may charge the projectile, when the projectile is positioned in the breech. In an embodiment, and as shown in FIG. 12, the breech may comprise conductive metal contacts (such as contact 108) and/or a conductive metal contact such as conductive spring finger 1036*c* that may contact the PCB 106 or complementary contacts 108 (as shown in FIG. 11) of the projectile when the projectile is positioned in the breech. The breech may thereupon energize the projectile by way of the metal contacts being disposed against the PCB 106 and/or complementary contacts 108 of the projectile.

In an embodiment, the energizable energy storage means is charged to or beyond the threshold energy by an inductive means. Such inductive means may be through wireless charging or by the movement of a coil within a magnetic field, for example. The magnetic field may be generated by permanent magnets, electromagnets, or the like, disposed within the launcher or as an accessory or accessories to the launcher.

Figure 13:
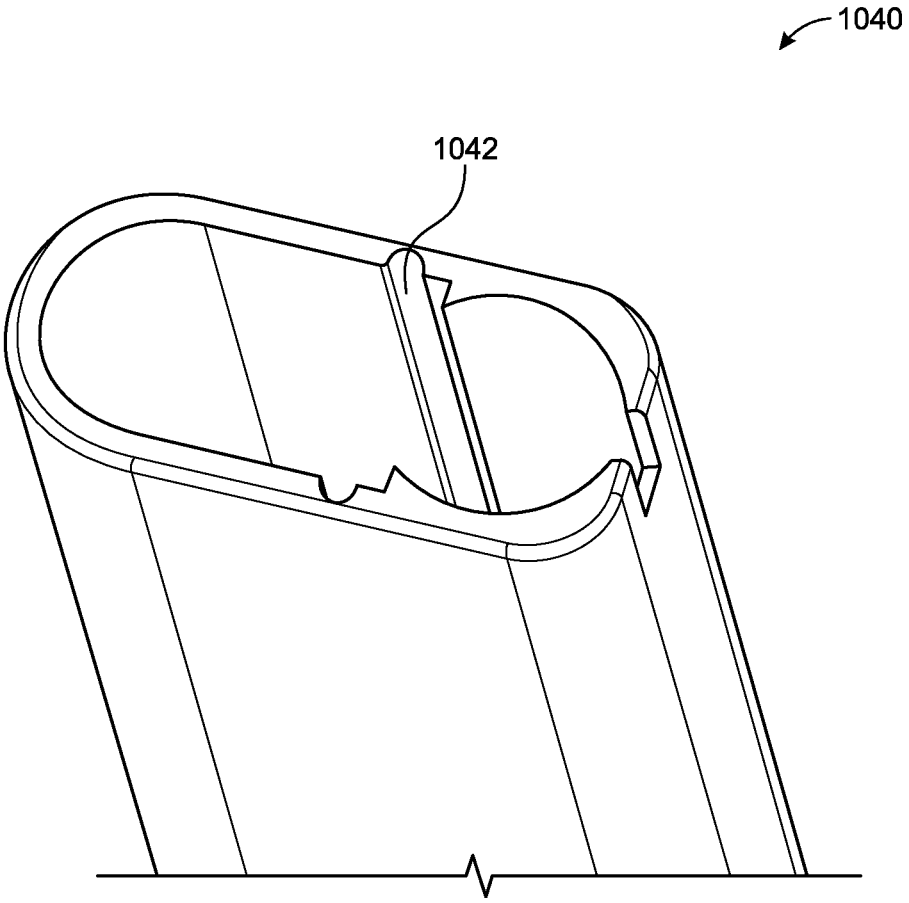
FIG. 13 shows a magazine, in accordance with an exemplary embodiment of the present disclosure.
Figure 14:
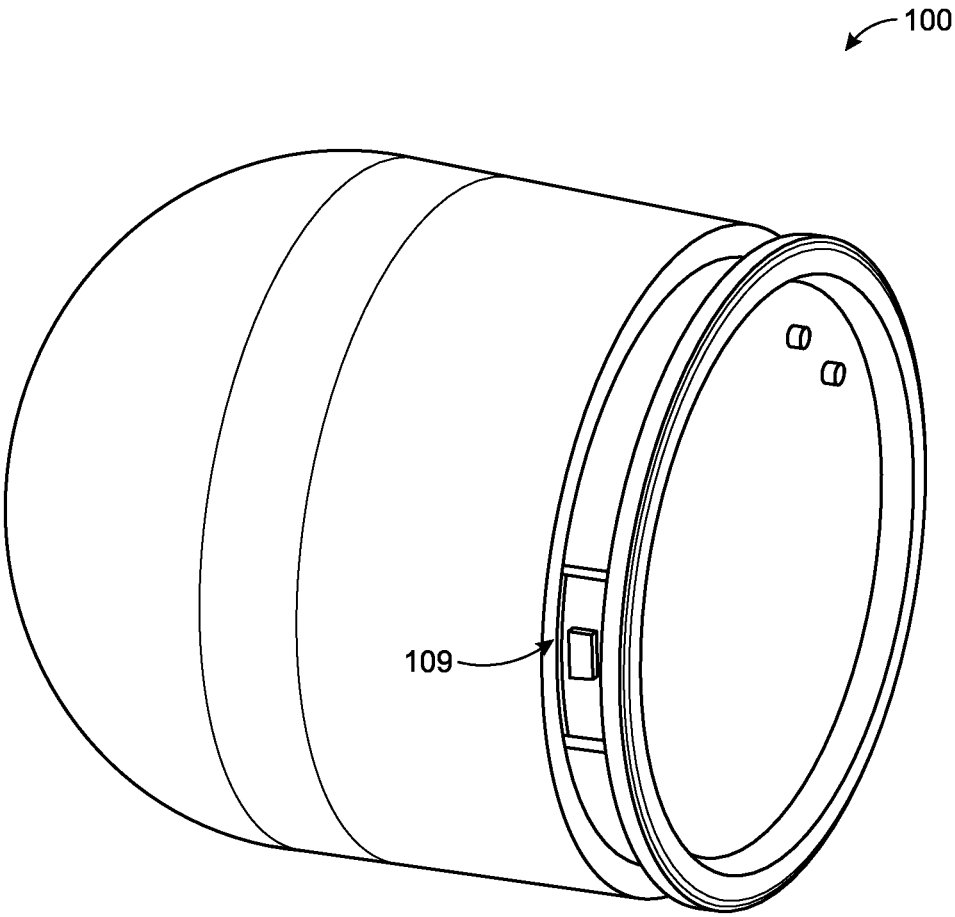
FIG. 14 shows a configuration of a projectile for energizing the projectile by the energy source of the magazine, in accordance with an exemplary embodiment of the present disclosure.

In another embodiment, the magazine 1040 comprises an energy source 1042. In an embodiment, the magazine comprises at least one rail or slot, which rail or slot may engage a complementary feature 109 of a projectile (such as an at least one parallel side 202 of the projectile or a contact 108 of the projectile). That is, the complementary feature of the projectile is received in a rail or slot of the magazine. The complementary feature of the projectile may comprise an electrical contact (or contacts) that is or are capable of receiving a charge and transmitting said charge to an energy storage means. The at least one rail or slot of the magazine comprise an energy source component such that when the projectile is disposed in the magazine, the contact(s) of the projectile are disposed against the energy source component of the magazine, thereby permitting the projectile to be energized by the magazine. In an embodiment, the energy storage means of the projectile is not energized until the magazine has been inserted into the launcher. An exemplary embodiment of such a magazine 1040 is shown in FIG. 13. An exemplary embodiment of a projectile with a complementary feature 109 is shown in FIG. 14.

In an embodiment, debilitating material of the payload 200 is mixed with an inert powder, which inert powder comprises a particle size of no less than 10 microns in diameter, as particle sizes of less than 10 microns have been shown to cause long-term health issues, and especially of the lungs and heart.

FIG. 1 represents a projectile launcher 1000 that is preferably based on electrical-driven or a combination of electrical and combustion or compressed gas means. It is understood that the projectile is not limited to a particular launching method but a preferable designed launcher in which the advantages of having an electronic control and communication element with the projectile can be used. Because the projectile is energizable by the launcher or other outside source, the possibility that the projectile would fail to operate due to draining of an internal battery is rendered moot.

The projectile and launcher disclosed herein offer the advantages of more controlled release of a payload than existing solutions can offer. For instance, a user can set the range and/or rate at which the payload is released by configuring parameters that control the opening in the projectile. The projectile does not require impact upon a target (therefore reducing the risk of injury to a target) to disperse and/or deliver the payload. Configuration of the shell of the projectile disclosed herein may also increase accuracy of flight of the projectile to further improve the safety of use of the projectile disclosed herein. Furthermore, the projectile can be kept in an unarmed state until the energy storage means is sufficiently energized, i.e., beyond a threshold energy. The energizing of the energy storage means by the launcher or other outside source eliminates the possibility that the projectile will suffer from power loss or failure prior to firing. It also provides for increased safety when transporting or handling projectiles.

The foregoing descriptions of specific embodiments of the present disclosure have been presented for purposes of illustration and description. They are not intended to be exhaustive or to limit the present disclosure to the precise forms disclosed, and obviously many modifications and variations are possible in light of the above teaching. The exemplary embodiment was chosen and described in order to best explain the principles of the present disclosure and its practical application, to thereby enable others skilled in the art to best utilize the disclosure and various embodiments with various modifications as are suited to the particular use contemplated.

What is claimed is:

1. A launcher and projectile system, the system comprising a launcher, a non-lethal projectile, said projectile comprising a housing, a payload, a control circuit, an energizable energy storage means, and an initiator, said initiator operatively coupled to said control circuit, wherein said payload comprises at least one of a powder, aerosol, foam, liquid, and marking substance and wherein said energizable energy storage means is energized past a threshold energy as part of the launch of the projectile, and wherein, after launch of said projectile, said projectile housing ruptures, disintegrates, separates, or otherwise has an opening created therein and releases said payload.

2. The system of claim 1, the launcher further comprising a trigger, and wherein the energy storage means is not energized beyond a threshold energy until at least one of actuation of the trigger and initiation of the projectile launch.

3. The system of claim 1, the launcher further comprising a breech assembly, said breech assembly comprising a bolt and a breech, said projectile receivable within the breech.

4. The system of claim 3, wherein the energy storage means is energized by the breech assembly of the launcher.

5. The system of claim 1, wherein said launcher control circuit controls at least one of the energizing of the projectile and the timing of the rupturing, disintegration, separation, or of creation of an opening of projectile.

6. The payload of claim 1, where the payload has at least one of a debilitating, an inert, and a marking effect.

7. The system of claim 1, wherein the housing of the projectile comprises at least one of polymer and an elastomeric material or combustible housing.

8. The system of claim 1, wherein the launcher further comprises a launcher accessory, and wherein at least one of said launcher and launcher accessory is capable of energizing the projectile.

9. The energy storage means of claim 1, wherein the energy storage means is charged to a voltage that corresponds to the timing of the opening of the projectile.

10. A non-lethal projectile, said projectile comprising a housing, a payload, a control circuit, and an energizable energy storage means, and an initiator, said initiator operatively coupled to said control circuit, wherein said payload comprises at least one of a powder, aerosol, foam, liquid, and marking substance, and wherein said energizable energy storage means is energized past a threshold energy as part of the launch of the projectile, wherein, after launch of said projectile, said projectile housing ruptures, disintegrates, separates, or otherwise has an opening created therein to release said payload.

11. The projectile of claim 10, said payload comprising a debilitating powder and an inert powder, said inert powder having a particle size of at least 10 microns in diameter.

12. The projectile of claim 10, wherein the projectile comprises at least one fracture line or frangible housing.

13. The projectile of claim 10, wherein the housing of the projectile comprises at least one of a polymer and an elastomeric material or combustible housing.

14. The payload of claim 10, where the payload has at least one of a debilitating, an inert, and a marking effect.

15. The projectile of claim 10, wherein the control circuit comprises at least one of a timing circuit, a GPS, and an RFID.

16. The projectile of claim 10 wherein the energizable energy storage means powers the control circuit during and after launch of projectile.

* * * * *